US009878466B2

(12) United States Patent
Alshaikh

(10) Patent No.: US 9,878,466 B2
(45) Date of Patent: Jan. 30, 2018

(54) SHRINKABLE CORE FOR FORMING HOLLOW PRECAST LOAD BEARING WALL PANELS

(71) Applicant: ALWATAN UNITS CO., LLC., Riyadh (SA)

(72) Inventor: Abdullatif Saleh Abdullah Alshaikh, Riyadh (SA)

(73) Assignee: ALWATAN UNITS CO., LLC, Riyadh (SA)

( * ) Notice: Subject to any disclaimer, the term of this patent is extended or adjusted under 35 U.S.C. 154(b) by 264 days.

(21) Appl. No.: 14/431,668

(22) PCT Filed: Sep. 26, 2013

(86) PCT No.: PCT/EP2013/070103
§ 371 (c)(1),
(2) Date: Mar. 26, 2015

(87) PCT Pub. No.: WO2014/049069
PCT Pub. Date: Apr. 3, 2014

(65) Prior Publication Data

US 2015/0251333 A1 Sep. 10, 2015

(30) Foreign Application Priority Data

Sep. 27, 2012 (EP) ..... 12186355

(51) Int. Cl.
*B28B 7/18* (2006.01)
*B28B 7/00* (2006.01)
(Continued)

(52) U.S. Cl.
CPC ..... *B28B 7/18* (2013.01); *B28B 7/0041* (2013.01); *B28B 7/0079* (2013.01); *B28B 7/186* (2013.01);
(Continued)

(58) Field of Classification Search
CPC ..... B28B 7/0079; B28B 7/18; B28B 7/30
See application file for complete search history.

(56) References Cited

U.S. PATENT DOCUMENTS 1,451,049 A 4/1923 Newman
2,472,068 A 6/1949 Farley

FOREIGN PATENT DOCUMENTS

CN 2531007 Y 1/2003
FR 1006445 A 4/1952
(Continued)

OTHER PUBLICATIONS

The "International Search Report and Written Opinion of the International Searching Authority, or the Declaration" dated Jan. 15, 2014 for the International Application No. PCT/EP2013/070103 of which the above-captioned instant U.S. Appl. No. (not yet designated) is a U.S. national phase application.

*Primary Examiner* — James Sanders
(74) *Attorney, Agent, or Firm* — Wood, Phillips, Katz, Clark & Mortimer

(57) ABSTRACT

A shrinkable core (100) for inserting in a mold (200) for forming a precast load bearing wall panel having a cavity, the shrinkable core (100) comprises a first wall (110) and a second wall (120), a first side element (112) and a second side element (122), and a spacing element (130). The first wall (110) and second wall (120) are spaced from each other by a first distance (d1) to define an internal region (115) in-between. The first side element (112) and the second side element (122) are arranged to close opposite edge portions of the spaced first wall (110) and second wall (120) such that fluid concrete cannot pass the opposite edge portions to get into the internal region (115), the first side element (112) and second side element (122) being spaced by a second distance (d2). The spacing element (130) is configured to vary at least one of the first distance (d1) and the second distance (d2)
(Continued)

such that a circumference along the first and second walls (110, 120) and the first and second side elements (112, 122) shrinks monotonically with lowering said at least one distance.

1 Claim, 6 Drawing Sheets

(51) Int. Cl.
*B28B 7/30* (2006.01)
*E04G 15/06* (2006.01)
*E04C 2/30* (2006.01)

(52) U.S. Cl.
CPC ..... *B28B 7/30* (2013.01); *B28B 7/303* (2013.01); *E04C 2/30* (2013.01); *E04G 15/065* (2013.01); *Y10T 428/13* (2015.01); *Y10T 428/1328* (2015.01)

(56) References Cited

FOREIGN PATENT DOCUMENTS

| | | | |
|---|---|---|---|
| GB | 227374 | A | 1/1925 |
| GB | 798231 | A | 7/1958 |
| GB | 954390 | A | 4/1964 |
| WO | 2006047754 | A2 | 5/2006 |

SHRINKABLE CORE FOR FORMING HOLLOW PRECAST LOAD BEARING WALL PANELS

FIELD OF THE INVENTION

The present invention relates to a shrinkable core to be inserted in a mold for forming a hollow precast load bearing wall panel, to a mold with the shrinkable core, and to a load bearing wall panel formed by the mold.

BACKGROUND OF THE INVENTION

Hollow load bearing wall panels (as e.g. concrete walls, or slabs) play an important role in the construction of buildings. On the one hand, hollow load bearing wall panels provide the advantage that they have a lower weight than solid blocks, thereby simplifying the transportation of the manufactured of these load bearing wall panels. On the other hand, the cavities inside the load bearing wall panels might either accommodate wires or tubes (for water or electricity), or may be used to provide a circulation of, for example, air to improve the climate within the building.

Conventional hollow concrete walls are formed by joining two elements with recesses such that between the joined elements a cavity is formed. A disadvantage of this manufacturing process relates to the fact that it involves the additional step of joining the separate concrete elements. In addition, there is always the issue in ensuring that the joined elements are connected securely.

Therefore, there is a need of providing a manufacturing system being able to be used for forming precast load bearing wall panels such as concrete walls and being able to cast them in a single step, i.e. as a unitary block with the cavity, thereby avoiding further steps of joining different concrete elements as in conventional casting systems.

SUMMARY OF THE INVENTION

The present invention relates to a shrinkable core, a mold for forming a precast load bearing wall panel and a load bearing wall panel.

According to the present invention a shrinkable core configured to be inserted in a mold for forming a precast load bearing wall panel (e.g. a building block) with a cavity, wherein the shrinkable core comprises a first wall and a second wall being spaced from each other by a first distance, a first side element and a second side element, wherein the first side element and the second side element close opposite edge portions of the spaced first wall and second wall such that fluid concrete cannot pass the opposite edge portions so that an internal, sealed region is defined in-between. The shrinkable core further comprises a spacing element configured to vary at least one of the first distance and a second distance between the oppositely arranged first side element and second side element such that a circumference along the first and second walls and the first and second side elements shrinks monotonically with lowering said at least one distance.

Concrete sets during a drying process so that such shrinkable core provides the advantage that it is able to adjust automatically to the drying and setting concrete. Therefore, when the concrete sets and becomes solid and while the concrete is still wet the shrinkable core is retracted and is detached from the concrete so that it can be released from the mold cavity. As a further advantage the concrete is prevented from sticking on the shrinkable core and the shrinkable core can be removed before the precast wall has dried. As a result, cracks or fractures in the concrete can are avoided, which may otherwise, if the core can not shrink, would occur during the drying process. As result, the formed cavity will have a high quality surface and the stability of the load bearing wall panel is not compromised. In addition, the shrinkable core allows to lift the load bearing wall panel after the drying process while leaving the core in the mold.

For providing a smooth setting process, the first and second walls may optionally comprise tilted portions (or curved portions) which engage with the first and second side elements such that the first and second distances can not be modified independently from each other, but by changing one of them the other one changes automatically due to the pressure applied by fluid concrete from the outside region and dependent on the particular engagement of the tilted portions. For example, the tilted portions are configured so that the first distance between the first and second wall is fixed by fixing the second distance between the first and second side elements, thereby enabling that by modifying the second distance between the first side and second side elements the first and second walls are moved accordingly relatively to each other.

Therefore, further embodiments of the present invention relate to a shrinkable core, wherein the first and second walls comprise a planar form with tilted portions being tilted towards the internal region, and wherein the first and second side elements comprise tilted side parts being tilted towards the internal region such that the tilted portions of the first and second walls are arranged in parallel to the tilted side parts of the first and second side elements so that the tilted portions and tilted side parts slide onto each other upon varying the at least one distance.

This arrangement provides the advantage that the spacing element needs only to vary one of the distances (e.g. the first or second distance dependent upon which one is arranged outside), thereby providing the effect that the shrinkable core shrinks monotonically upon activating the spacing element such that the first or second distances is varied continuously. Therefore, it becomes possible, that when the shrinkable core is surrounded by fluid concrete at the beginning, during the subsequent drying process the fluid concrete sets, and the shrinkable core can be adjusted accordingly to the drying process so that no cracks or fractures are formed in the precast concrete block. Optionally, the tilted portions at the first and second walls can also be formed as arc-shaped portions and, similarly the tilted side parts formed at the first and second side elements can also be formed as arc-shaped parts which are arranged parallel to each other, thereby providing the same effect that only one of the first or second distance has to be varied to modify both distances simultaneously—at least when pressure is applied by fluid concrete surrounding the shrinkable core.

Optionally, the shrinkable core may further comprise an attachment part, which is configured to attach and detach the shrinkable core within a mold (or formwork) in a vertical position at a bottom part of the mold to cast the wall panel with the cavity extending vertically. An advantage of this vertical manufacturing of precast load bearing wall panels is that the manufactured load bearing wall panel can, after the concrete has dried, be pulled out of the mold along the planar direction of the load bearing wall panel (for example by a crane). Therefore, the corresponding force is applied along the planar extension of the concrete wall, thereby minimizing the risk of damages, when the concrete wall would have to be lifted perpendicularly to its planar shape (for example due to bending).

Optionally, the spacing element may comprise expandable rod(s) to be connected to the side elements and/or to the first and second walls to adjust the distances between these elements accordingly. In addition, the spacing element may, optionally, comprise a gear box to impose the needed force on the rod arrangement to change gradually the first and/or second distance (for example in accordance with the drying process of the concrete). The driving force may either be supplied manually or by using a means for actuation (for example a motor).

Here and in the following, the top side is in the direction opposite the gravitational force so that the bottom side is in a direction where fluid concrete will flow to. Therefore, when forming the precast load bearing wall panel fluid concrete is poured in from the top side and the shrinkable core is attached to the bottom part of the mold so that the mold can be filled with fluid concrete surrounding the shrinkable core being arranged inside the mold until a predetermined level has been reached, wherein the shrinkable core exceeds the predetermined level, thereby producing an opening for the cavity formed within the precast load bearing wall panel.

Yet further embodiments relate to a mold arrangement, wherein the first and second outer wall comprise a planar shape and are configured to be moved perpendicular to the planar shape, and wherein the first and second outer side walls comprise a planar shape and are configured to be moved perpendicular to its planar shape. As result, the casted load bearing wall panel can be pulled out of the mold in a vertical direction without getting into contact neither with the core nor with outer walls. In addition, the first and second walls of the shrinkable core comprise a planar (e.g. rectangular) shape so that the formed cavity by the shrinkable core has planar side walls extending, for example, parallel to the side walls of the precast load bearing wall panel and thus parallel to an outside or inside wall of the building. The planar shaped shrinkable core may be attached to a bottom plate closing the mold from below by using, for example, the attachment part.

In the vertical manufacturing process of load bearing wall panels, the shrinkable core will form an opening at the top part and bottom part of the load bearing wall panel. In addition, it may be of advantage to have also at both side parts of the load bearing wall panel openings which are connected to the cavity within the load bearing wall panel. To achieve such openings the first and second outer side walls may comprise protrusions which extend into the cavity of the mold, for example, up to the shrinkable core such that when fluid concrete is filled in the mold it will also surround the protrusions and thus the formed cavity will also open to one or both sides of the casted concrete load bearing wall panel.

Therefore, in further embodiments the first and second outer side walls comprise one or more protrusions which extend in the mold and are configured to get into contact with at least one of the first and second side elements of the shrinkable core when it is inserted in the mold such that after casting the load bearing wall panel with the cavity formed by the shrinkable core, the cavity comprises one or more further openings perpendicular to the two openings along the lateral extending of the shrinkable core (i.e. at the top and bottom side).

As for the shrinkable core the protrusion should likewise provide additional space during the drying process of concrete. This may be achieved by using a tapered shape for the protrusions so that by moving the first and second outer side wall outwardly during the drying process further room is provided to the concrete for setting during the drying process. Therefore, further embodiments relate to a mold, wherein the at least one protrusion comprises a tapered shape with an increased cross-sectional area towards the at least one outer side wall to allow during or after the drying process of the fluid concrete to remove the at least one of the first and second outer side walls in a horizontal direction.

As a result, the manufactured load bearing wall panel has a cavity within the exemplary concrete which opens in four directions which are perpendicular to each other (one to the top, one to the bottom, one to the right-hand side and one to the left-hand side when viewed on the planar side of the load bearing wall panel).

In further embodiments it is also possible to combine various shrinkable cores within one mold such that multiple cavities can be formed within the load bearing wall panel, which may or may not be connected with each other.

Yet further embodiments relate to a mold, wherein the first and second outer walls and the first and second outer side walls are arranged in vertical positions, wherein the mold arrangement further comprises a bottom element for closing the mold at the bottom such that fluid concrete can be filled into the mold from a vertical upper position. In addition, the attachment part of the shrinkable core may fix the shrinkable core to the bottom part and the shrinkable core extends at least up to a vertical level to which the fluid concrete is to be filled in the mold such that the precast wall comprises a through-hole along the vertical direction, and wherein the first and second outer side walls comprise each two protrusions, which are separated from each other so that the precast wall comprises in addition on each side two openings being connected to the cavity formed by the shrinkable core.

Optionally, the mold may comprise additional projections and groove parts which extend in a vertical direction inside the molding cavity such that the formed load bearing wall panel comprises respective grooves and projections which are adapted to engage with each other during the building process to provide an improved connection between different load bearing wall panels to improve the stability of the building. For example, the outer side wall may have these further projections extending from the bottom part to a top of the first outer side wall, and the second outer side wall may comprise the respective grooves extending from the bottom part to the top of the second side wall such that these further projections and the further grooves are formed to cast grooves/projections which fit with each other at the side parts of the precast load bearing wall panel.

The mold may further comprise a frame which is connected to the outer walls and the outer side walls and provides actuation means for moving each of these walls separately in horizontal directions. Therefore, in these embodiments the framework with the means for moving the first and second outer side walls as well as the first and second outer side walls enable a relative movement with respect to the framework in horizontal directions (x- and y-direction). This frame may be configured to be installed on a vehicle such that the mold becomes mobile and can be moved to the construction site, thereby avoiding the transportation of the precast concrete walls. Hence, the concrete walls can be manufactured on site. Optionally, the vehicle may further comprise a crane to pull the precast walls after a drying process out of the mold.

Embodiments relate also to a process of manufacturing the load bearing wall panels, in which the mold walls (i.e. the first and second outer walls, first and second outer side wall) are opened to outside, lubricant is applied on each wall, after which, the walls are closed to create the mold cavity. The lubricant may optionally also be applied to the shrinkable core before installing it in the mold cavity. Next, the shrinkable core is installed in a closed position to fit in the mold's bottom plate, wherein in the closed position the distances d1 and d2 comprise minimal values. As next step, the shrinkable core is expanded using the rod arrangement which actuates the driving rods to expand/open the shrinkable core. As next step, concrete mix is poured inside the mold cavities and the concrete is left to set and dry. Optionally, steam is turned on to accelerate the drying process. When the concrete is dry and solid, the shrinkable core is retracted to its closed position, the attachment elements are un-tightened and the shrinkable core is lifted. Finally, the molds doors (i.e. the first and second outer walls, first and second outer side wall) are opened to lift the precast wall without damaging the mold's walls.

The present invention provides the advantage that a load bearing wall panel (for example made of concrete) can be formed with a cavity as a unitary block without the need of combining different concrete elements. Since the core is shrinkable according to the present invention, the core size can be adjusted in accordance with the drying process of concrete, thereby avoiding fractures and cracks in the surface of the concrete and improving thus the quality of the manufactured concrete load bearing wall panels. Moreover, the present invention provides the advantage that a mold can be transported to the construction site thereby enabling to form the desired load bearing wall panels directly on site and on demand.

BRIEF DESCRIPTION OF THE DRAWINGS

The present invention will now be described by way of examples only, with reference to the accompanying drawings, in which.

DETAILED DESCRIPTION OF THE INVENTION

In the following directions are identified using a Cartesian coordinate system (x, y, z), wherein the z-direction is the vertical direction (against the gravitational force) and the x- and y-directions are both horizontal directions, wherein the x-direction defines a thickness direction of load bearing wall panel whereas the y-direction is the width direction.

Figure 1:
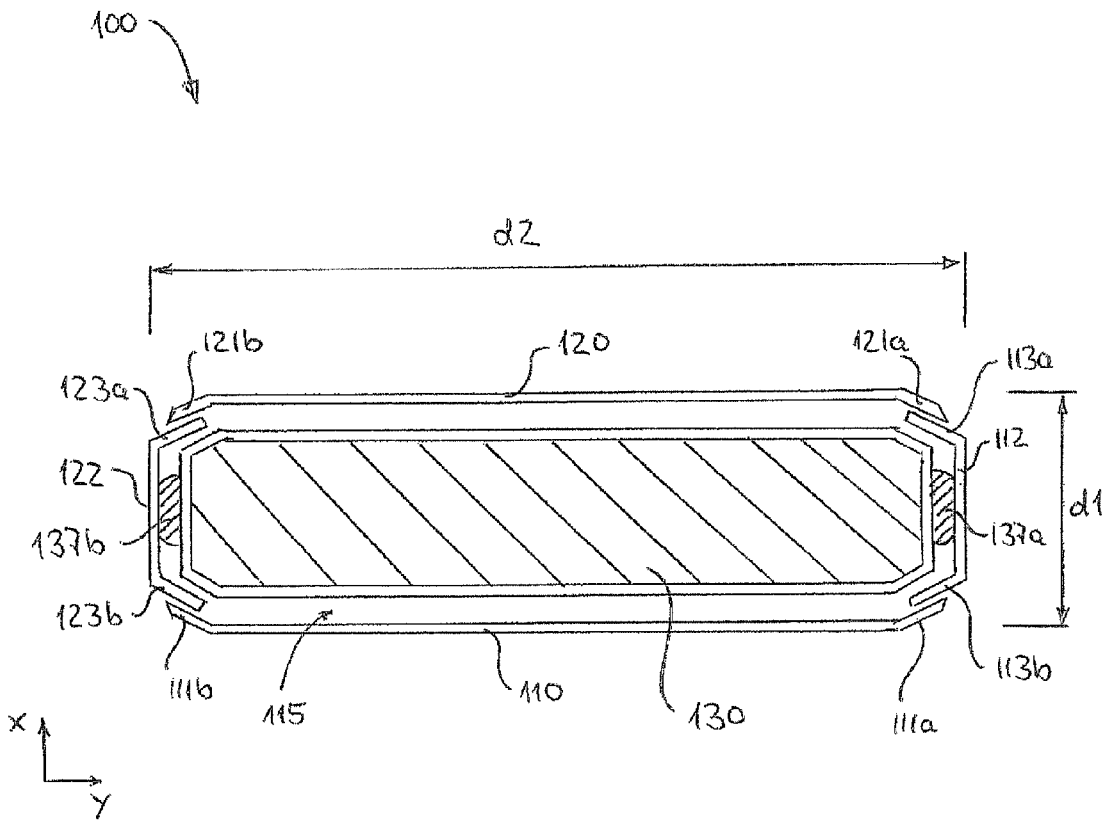
FIG. 1 depicts a cross-sectional view of a shrinkable core according to an embodiment.

FIG. 1 depicts a cross-sectional view (in horizontal x-, y-directions) of the shrinkable core 100 according to an embodiment of the present invention. It comprises a first wall 110 and a second wall 120 being spaced from each other by a first distance d1 to define an internal region 115 in-between. A first side element 112 and a second side element 122 close opposite edge portions of the spaced first wall 110 and second wall 120 such that fluid concrete cannot pass the opposite edge portions to get into the internal region 115, i.e. the first and second side elements 112, 122 seal the edge portions for fluid concrete. The first and second side elements 112, 122 are separated from each other by a second distance d2.

The shrinkable core 100 further comprises a spacing element 130 which is configured to vary the second distance d2 between the oppositely arranged first side element 112 and second side element 122 under a pressure of concrete from the outside region. The first and second side elements 112, 122 are fixed by the spacing element 130 by using attachment parts 137*a,b*. The spacing element 130 modifies in this example only the second distance d2 resulting into a shrinking a circumference along the first and second walls 110, 120 and the first and second side elements 112, 122 when the second distance d2 is lowered. This effect is caused by tilted portions/parts to be described next.

Optionally, a holding parts are arranged to hold or provide guidance for the first and second wall 110, 120 without, however, applying a driving force.

In the further embodiments the attachment parts 137 couple to the first and second wall 110, 120 and the tilted portions are arranged inside, so that only the first distance d1 is lowered by the spacing element 130 to thereby lowering the second distance accordingly.

In the embodiment as shown in FIG. 1 the first wall 110 comprises a first tilted portion 111*a* and a second tilted portion 111*b* arranged at opposite ends in the y-direction. Similarly, the second wall 120 comprises a first tilted portion 121*a* and a second tilted portion 121*b* arranged at opposite edge portions along the y-direction. These tilted portions extend in the vertical z-direction from a bottom part to a top part. Similarly, the first side element 112 comprises a first tilted side part 113*a* and a second tilted side part 113*b* between which a planar part of the first side element 112 extends. In the same way, the second side element 122 comprises a first tilted side part 123*a* and a second tilted side part 123*b*, between which a planar part of the second side element 122 extends.

The first and second side element 112, 122 may contact directly the first and second side wall 110, 120 (or the tilted portions 121*a*, 121*b*, 111*a*, 111*b* thereof). Optionally, sealing means may be arranged between side elements and side walls. The tilted portions/parts of the first and the second walls 110, 1.20 and the first and second side elements 112, 122 may be arranged in parallel to each other such that they can slide on each other and provide a closure so that fluid concrete filled around the shrinkable core 100, but cannot enter the internal region 115.

In addition, the first and second walls may comprise metal or steal and comprise a thickness (e.g. 5-30 mm) to withstand the pressure of fluid concrete filled in the mold.

Figure 2:
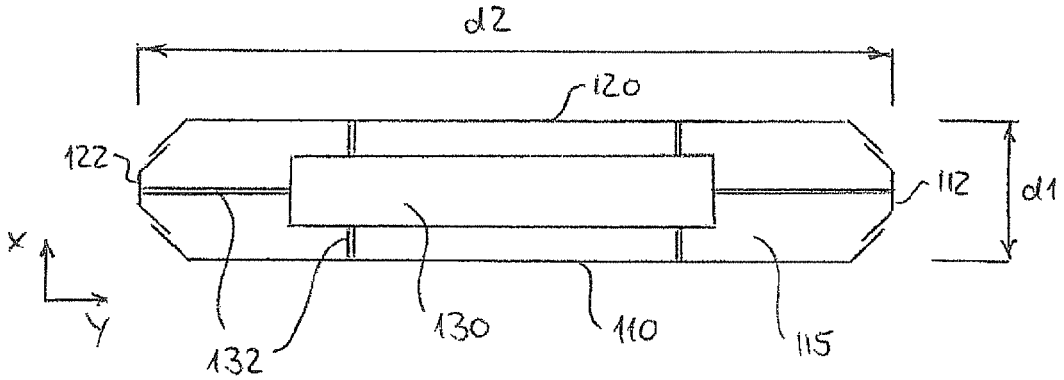
FIG. 2 depicts a cross-sectional view of the shrinkable core according to a further embodiment.

FIG. 2 depicts a further embodiment of the shrinkable core 100 with the first and second walls 110, 1.20 and the first and second side elements 112, 122 arranged as in FIG. 1. However, differently to FIG. 1 the spacing element 130 comprises a rod arrangement 132 being adapted to modify the first distance d1 and the second distance d2 to thereby modify the circumference of the cross-sectional area covered by the shrinkable core 100 in the horizontal (x, y)-plane.

In this embodiment the shrinkable core 100 comprises one or more expandable rod arrangements 132 to adjust the first distance and/or the second distance. For example, a first rod arrangement is configured to vary the first distance d1 and a second rod arrangement is configured to vary the second distance d2 by a predetermined amount (e.g. in a range of 1 to 3 cm or about 2 cm). This rod arrangements may be driven manually or by using a respective drive (e.g. a motor), and a gear box may be provided to transform the driving force into an expansion/retraction force of the rod arrangement 132.

The embodiments of FIGS. 1 and 2 allow two possible ways to arrange the tilted portions relative to the tilted side parts. For example, the tilted portions 111, 121 may either be arranged inside the tilted side parts 113, 123 (i.e. towards the internal region 115) such that, when the first distance d1 is lowered, the tilted portions 111, 121 of the first and second wall 110, 120 and the tilted side parts 113, 123 of the first and second side elements 112, 122 move parallel to each other, thereby decreasing the second distance d2 and thus the circumference of the cavity. Another possibility is that the tilted portions 111, 121 are arranged outside the tilted side parts 113, 123 (i.e. opposite to the internal region as in FIGS. 1 and 2) so that the first distance d1 is varied by varying the second distance d2. Both arrangements are equivalent and define only the one distance that is varied causing the other distance to adjust accordingly.

The first or second side parts 112, 122 may, optionally, be unitarily formed with the first and second side walls 110, 120 such that on either side of the edge portions only one sliding arrangement is formed (only one gap is formed on either side).

Figure 3A:
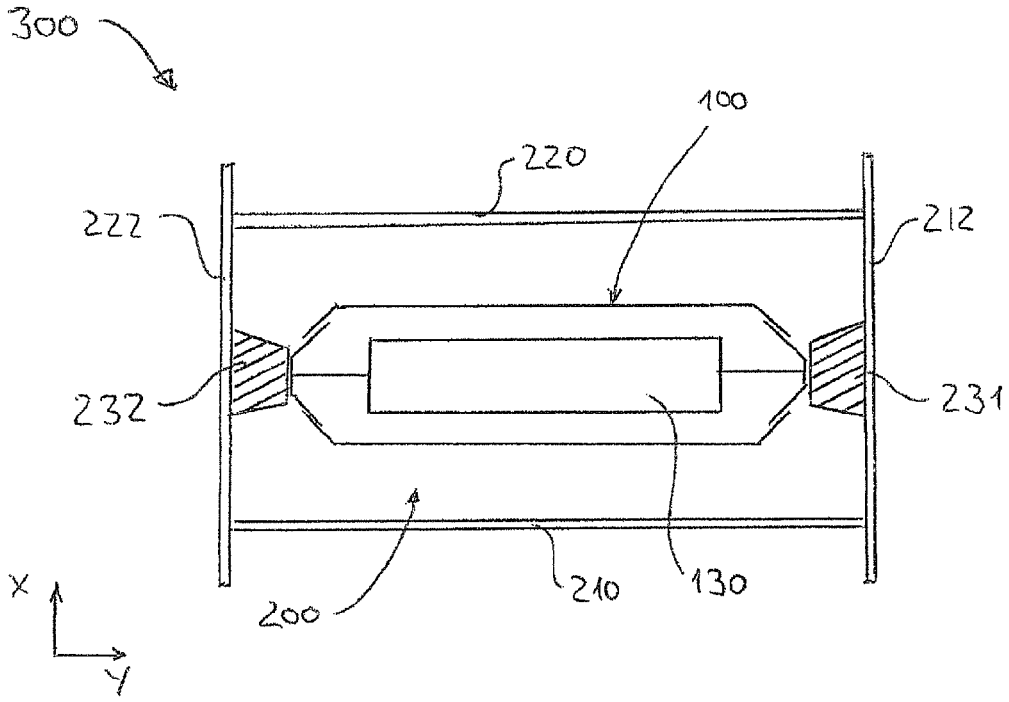
FIG. 3*a,b* depict an overview and a cross-sectional view of a mold with the shrinkable core according to an embodiment.
Figure 3B:
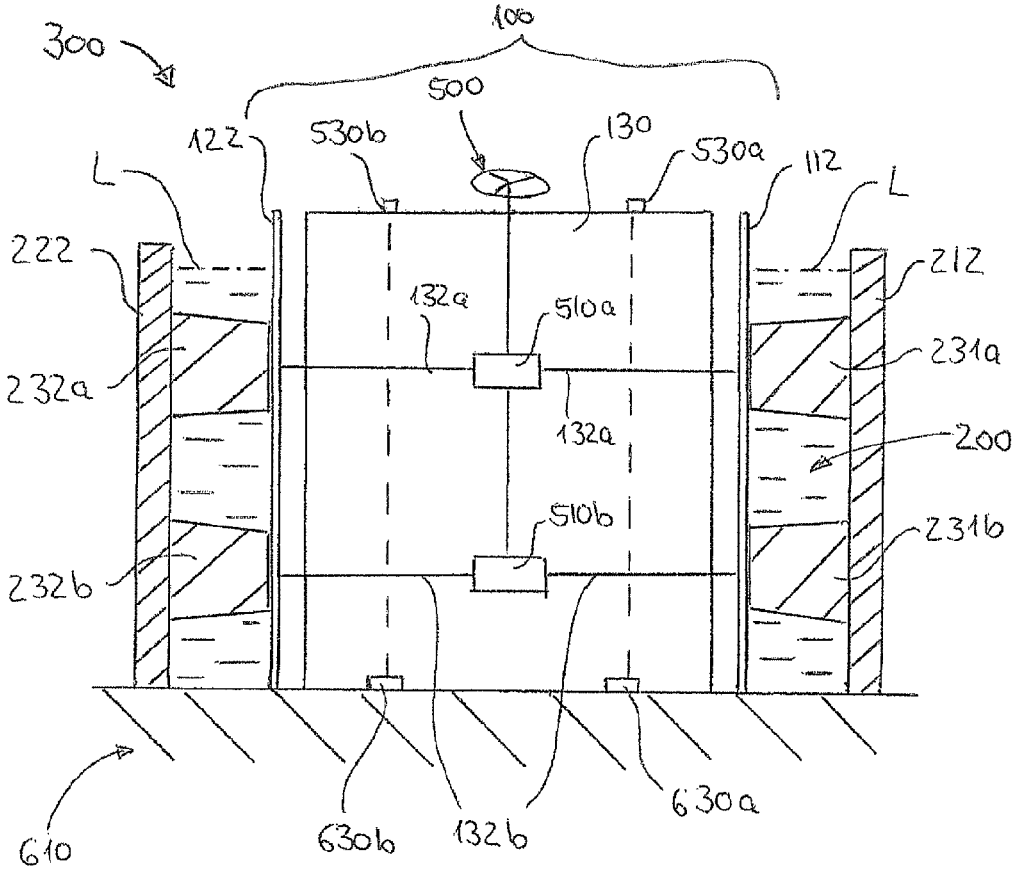
Figure 3B:
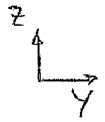

FIGS. 3*a,b* depict a mold arrangement 300 with the shrinkable core 100 according to a further embodiment, wherein FIG. 3*a* shows a cross-sectional view in the x,y-plane and FIG. 3*b* shows a cross-sectional view in y,z-plane. The mold arrangement 300 comprises the shrinkable core 100 arranged in a vertical direction (extending along the z-direction) so that the thickness direction of the shrinkable core 100 is perpendicular to the vertical direction (in x-direction).

The molding arrangement 300 as depicted in FIG. 3*a* comprises a first outer wall 210 and a second outer wall 220, which are arranged in parallel and are closed on one side by a first outer side wall 212 and on the other opposite side by a second outer side wall 222 to define a mold cavity 200 in between (when it is arranged on a bottom plate not shown in FIG. 3*a*). In addition, the first outer side wall 212 comprises one or more first projection 231, and the second outer side wall 222 comprises one or more second projections 232 extending from the first and second outer side walls 212, 222 up to the shrinkable core 100. As result, the formed load bearing wall panel will comprise additional openings of the cavity formed by the shrinkable core 100 on both sides in the y-direction.

FIG. 3*b* depicts a cross-sectional view of the mould arrangement 300 as shown in FIG. 3*a* along the z,y-plane. The mould arrangement 100 comprises again on the right-hand-side the first outer side wall 212 and on the left-hand-side the second outer side wall 222. The first outer side wall 212 comprises two protrusions (or projections) 231*a*, 231*b*, which are arranged separated from each other along the z-direction. Similarly, the second outer side wall 222 comprises likewise two projections 230*a*, 230*b*, which are also separated from each other along the vertical Z-direction. The projections 231 and 232 extend from the first and second outer side walls 212, 222 up to the first side element 112 (for the projections 231 of the first outer side wall 212) and the further projections 232 of the second outer side wall 222 extend up to the second side element 122. The first and second side elements 112, 122 are coupled to the rod arrangement 132 such that the rod arrangement 132 adjusts the second distance d2 between the first and second side elements 112, 122.

In the embodiment as shown in FIG. 3*b*, a first and second gear box 510*a* and 510*b* are arranged between the two expandable or extendable rods 132*a*, 132*b* of the rod arrangement 132 to provide a force for maintaining or varying the second distance in d2. The gear boxes 510 are driven manually by using a driving rod arrangement 500 so that construction workers can adjust the second distance d2 in accordance with a drying process of a fluid concrete. The first and the second gear box 510*a*, 510 convert a rotational force applied by a construction worker by using the driving rod 500 into translational forces acting on the extendable rod arrangement 132*a,b*.

FIG. 3*b* further depicts the button plate 610 onto which the mould arrangement 300 is attached. This attachment is provided for the shrinkable core 100 by using attachment elements 630*a*, 630*b* being fixed to the ground plate 610 (button plate) and are connected by further rods with further attachment elements 530 provided at the top of the shrinkable core 100. Therefore, a first attachment element 630*a* is connected with a first further attachment element 530*a* and a second attachment element 630*b* is connected with a further second fixing element 530*b* to provide a secure attachment for the shrinkable core 100 on the base plate 610.

FIG. 3*b* depicts also that the shrinkable core 100 extends above the first and second outer side walls 212 and 222 and, in particular, above a filling level L up to which fluid concrete is filled within the molding cavity 200.

Figure 4:
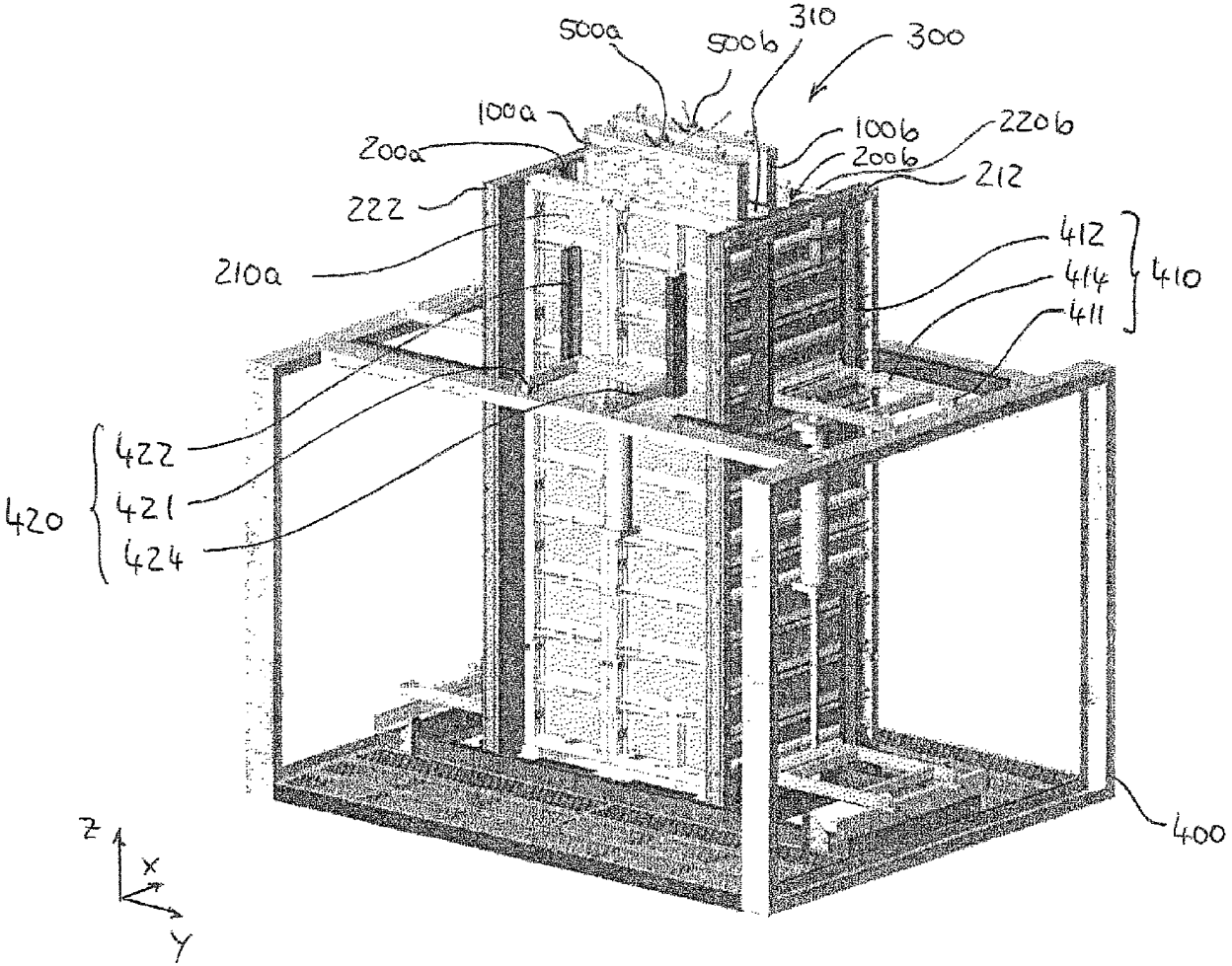
FIG. 4 depicts a perspective view of the mold together with the frame and the shrinkable core inserted in the mold according to an embodiment of the present invention.

FIG. 4 depicts a perspective view of the molding arrangement 300, wherein a first mold cavity 200*a* and a second mold cavity 200*b* are formed adjacent to each other and are separated by a partition wall 310. The first mold cavity 200*a* is formed between a first outer wall 210*a* and the partition wall 310 and the second mold cavity 200*b* is formed between a second outer wall 220*b* and partition wall 310. The side faces are closed by a first outer side wall 212 and on the other, opposite side (along the y-direction) by a second outer side wall 222 which extend along both mold cavities 200*a,b*. In addition, the first mold cavity 200*a* comprises a first shrinkable core 100*a* and the second mold cavity 200*b* comprises a second shrinkable core 100*b* arranged vertically so that a top portion extends above the first and second mold cavities 200*a,b*.

In addition, in the embodiment as shown in FIG. 4, the first and second outer wall 210*a*, 220*b* and the first and second outer side walls 212, 222 are arranged within a frame 400 providing actuating means 410, 420 by which the first and second outer wall 210*a*, 220*b* and the first and second outer side walls 212, 222 can be moved in horizontal direction, i.e. in the x-direction or the y-direction. For example, the movement of the first outer side walls 212 is achieved by an element 414 which is pivotable about an axis 411 (parallel to the x-direction) and engages with tracks 412 on the first outer side wall 212 so that upon a rotation of the element 414 the outer side wall 212 is driven in a horizontal y-direction. Similarly, the first outer wall 210*a* is movable horizontally (in x-direction) by an engagement of a further pivotable element 424 rotatable about the axis 421 and engaging a further track 422 being arranged along the first outer side wall 210*a*. Analogous actuating means are provided for the second outer side wall 222 and the second outer wall 220*b* to move them in the respective opposite directions when compared the first outer wall 210*a* and first outer side wall 212.

Optionally, the frame 400 is configured to be mounted on a vehicle such that the mold arrangement 300 as depicted in FIG. 4 can be moved to a construction site thereby allowing the manufacturing of load bearing wall panels on site without the need to move the precast load bearing wall panels from a manufacturing site to the construction site. As result, a mobile mold form arrangement is obtained which can be flexibly moved to different construction areas.

As shown in FIG. 4 the shrinkable cores 100*a, b* are attached to the bottom side and, in addition, comprise a manual actuating means 500 which is configured that upon rotation the first and second outer side elements 212, 222 are moved in the horizontal y-direction in opposite directions to each other. Therefore, both molding cavities 200*a, b* are enlarged (because the core shrinks) and after the drying process the load bearing wall panels can be pulled out easily.

Figure 5:
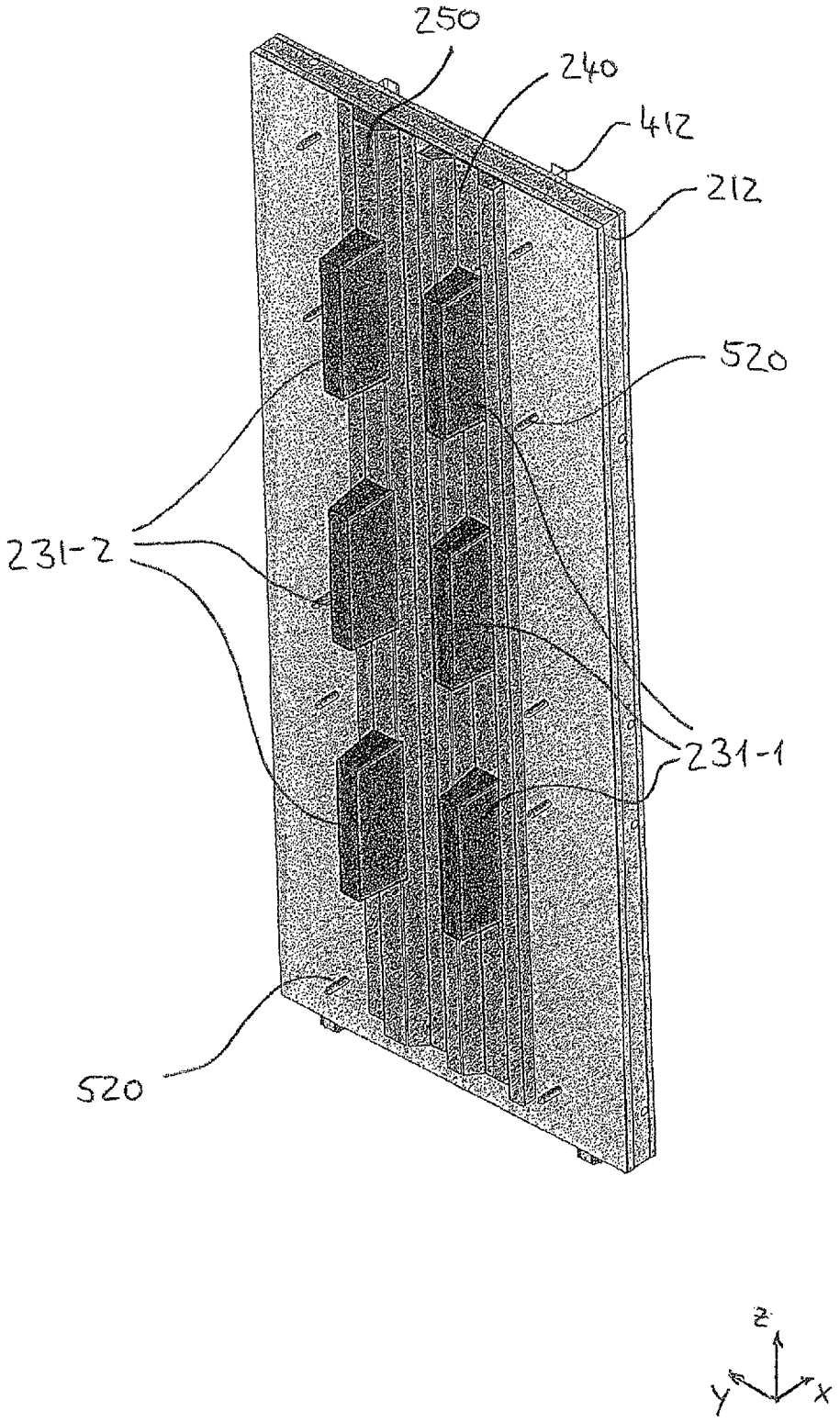
FIG. 5 shows a perspective view on an outer side wall with protrusions according to further embodiments.

FIG. 5 depicts a perspective view on one of the outer side walls 212 (or 222) arranged in vertical direction with the projections 231 (or 232). In this embodiment three projections 231 are formed along the z-direction so that the precast concrete wall will comprise on either side three openings connecting the cavity inside the load bearing wall panel with the outside.

The outer side wall 212 of FIG. 5 corresponds to the outer side wall 212 as used in the molding arrangement of FIG. 4, so that it will cover a side part of two adjacent molding cavities 200*a, b*, wherein three projections 231-1 are provided for the first molding cavity 200*a* and three projections 231-2 are provided for the second molding cavity 200*b*. In addition, the outer side wall 212 of FIG. 5 comprises abutment elements 520, which are configured to provide an abutment for the first outer wall 210*a* or the second outer wall 220*b*, such that the actuating means 420 (see FIG. 4) will drive the first outer wall 210*a* and the second outer wall 220*b* up to the abutment elements 520, as depicted in FIG. 5. Moreover, the outer side wall 212 from FIG. 5 shows also the engagement tracks 412 for providing a sliding path for the pivotable element 414.

In addition, FIG. 5 depicts an extended groove portion 240 and an extended projection portion 250 extending along the vertical z-direction. The extended groove portion 240 and extended projection portion 250 are configured such that the concrete walls formed by using this outer side wall will also comprise a respective grooves/projections which can engage (i.e. the projection 250 is formed such that its shape will fit into the groove 240). The resulting grooves/projections formed on the concrete wall will provide an addition stability when they engage in the building process by stabilizing the connection between adjacent load bearing wall panels when using for construction.

Figure 6A:
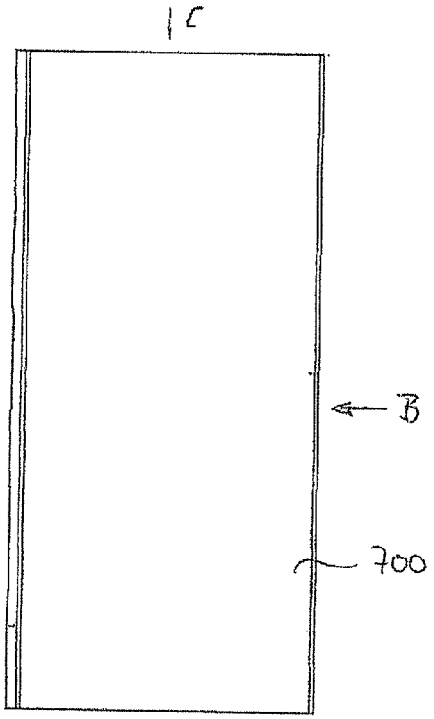
FIGS. 6*a-c* depict a side view, a top view and a front view of a manufactured load bearing wall panel according to an embodiment of the present invention.
Figure 6B:
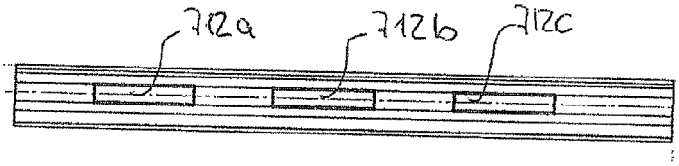
Figure 6C:
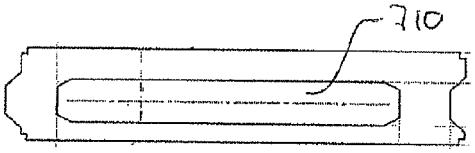

FIGS. 6*a* to 6*c* depict a concrete load bearing wall panel being manufactured by using the molding arrangement 300 as depicted, for example, in FIG. 4 with a shrinkable core 100 as depicted in FIG. 1 or 2. FIG. 6*a* shows the load bearing wall panel from a side view (in x-direction), FIG. 6*b* shows the load bearing wall panel from the side "B" (the z,y-plane) and FIG. 6*c* shows the load bearing wall panel from the top from the "C" side (the x,y-plane).

As shown in FIG. 6*b*, the load bearing wall panel comprises three openings 712*a,b,c* being connected to the cavity 710 as depicted, for example in the top view of FIG. 6*c* are formed by projections 231 in FIG. 5. Therefore, the cavity 610 is not only open at the top and bottom side of the load bearing wall panel, but has also on each side three further openings 712. In further embodiments the number of opening may be different as well as its relation location may modified as needed.

In further embodiments the frame 400 is or can be arranged inside a container such that the manufacturing arrangement can be moved easily to a construction site by using a vehicle. The frame may comprise multiple moldings, for example, eight or four moldings being arranged adjacent to each other so that multiple concrete load bearing wall panels can be manufactured in parallel. In further embodiments, compressed air or hydraulics are used to move the walls back and forth after end before a concrete wall is formed. Moreover, steam may be used to be injected inside the container to heat the surroundings and to make the concrete (cement) dry, thereby providing better quality concrete elements. In addition, the steam may also be injected inside the hollow part of the walls, thereby improving the drying process also inside the cavity.

The movable side walls and side elements may be moved about 5 mm to 5 cm or about 1 cm during the drying process or afterwards to allow the lifting of the manufactured load bearing wall panel.

The manufactured load bearing wall panels comprise the advantage that air can go through the cavities to cool the walls instead of using insulations. Moreover, the side openings being connected to the wall may be used for electrical, plumbing or other wires or pipes to go through from one wall to another, because the side openings are arranged at an equal height relatively to each other.

Moreover, the cavities in the walls can be used to allow air circulations, either normal air or evaporated cooler (for example by having an exhaust fan at one end of the building and water running on some water-retaining material at the other end). Optionally, water-retaining material such as for example volcanic rocks, can be inserted in the cavity such that water is retained there.

As for the moving manufacturing assembly, the container including the multiple molds can be combined with a crane arranged on the vehicle to move the precast concrete walls after the drying process out of the molding. Optionally, the crane may also be replaceable to improve the mobility of the vehicle.

Therefore, the present invention provides precast concrete hollow walls, which may be completely hollow with openings on the top, bottom and sides (edges). The concrete walls may contain iron bars, nets (for example with a thickness of 4 mm) for the walls, and supported by 8 and 10 mm iron bars. The thickness of the iron bars and nets depends on structural design of the building. The completely hollow concrete walls give complete freedom for plumbing and electric work being arranged inside of the cavity of the walls of the building. The cavity may either be used for adding heat insulating materials or to be used for pumping hot or cold air between the walls. Projections on one edge and the groove on the other edge (also for top and bottom edges) may help to firmly fit walls together with each other. Walls can be manufactured in a standard size (either big or small) and some of them comprise openings for windows and others for doors. Some also have openings for plumbing and electrical maintenance and for installing electrical boxes.

The concrete may be dried with hot steam for 3 to 4 hours and in the hollow inner part a metal body (shrinkable core) is placed that will be enlarged by 2 cm and will retract when the concrete is drying about the 2 cm to allow moving the core out of the hollow part. Therefore, in further embodiments the relative movement of the first and second outer side elements 212, 222 and the first and second walls 110, 120 are configured to be movable about a predetermined distance (for example between 1 to 5 cm or preferably around 1 cm) in opposite directions.

In yet another embodiments the shrinkable core comprises the tilted portions of the first and second walls and the tilted side parts of the first and second side elements being formed at least piece-wise a planar shape or comprise at least piece-wise an arc shape. In addition, one or both of the first and second side elements 112, 122 are formed unitarily with one of the first and second walls 110, 120.

For example, the first side element 112 may be formed unitarily with the second wall 120 and the second side element 122 may be unitarily formed with the first wall 110 and may comprise either the tilted shape as depicted in FIG. 1 or 2, may also be formed in an arch-shape such that two archs are arranged on top of each other and are relatively moveable to each other to provide the desired effect that the core shrinks in the sense that the cross-sectional area or the circumference of the core can be monotonically increased or decreased by using respective driving elements.

Embodiments relate also to a process of manufacturing the load bearing wall panels using the manufacturing facilities as depicted in FIGS. 4 to 6. During this process the mold walls (i.e. the first outer wall 210, the second outer wall 220, first outer side wall 212, the second outer side wall 222) are opened to outside allowing workers to go inside the mold cavity 200 and to apply lubricants on each wall. This lubricant may, for example, comprise oil, diesel or chemicals so that the concrete does not stick on the walls when concrete sets or dries. If the there is a double mold as depicted in FIG. 6, the partition wall 310 that separates the two molds 200*a*, 200*b* may not be moved and is fixed.

When the lubricants is applied, the walls are closed to create one or more mold cavities 200*a*, 200*b*. In addition, the lubricant is applied to the one or more shrinkable cores 100*a*, 100*b* before installing it in the one or more mold cavities 200*a*, 200*b*. Next, the one or more shrinkable cores 100*a*, 100*b* are installed, wherein the shrinkable cores 100*a*, 100*b* are in the closed position to fit in the mold's bottom plate 610. In this closed position the distances d1 and d2 are at their retracted/close position (e.g. have minimal values).

Then the one or more shrinkable cores 100*a*, 100*b* are fixed in the mold's bottom plate 610 with the attachments elements 630*a,b* that are controlled from the top by using elements 530*a,b*. As next step, the one or more shrinkable cores 100*a*, 100*b* are expanded using the rod arrangement 500, 132 which actuates the driving rods 132*a, b* to expand/open the one ore more shrinkable cores 100*a*, 100*b* to fit in the mold's bottom plate and become stable.

The role of the one or more shrinkable cores 100*a*, 100*b* are to create the vertical cavities in the precast wall panel and they may be removed before releasing the wall from the mold. This provides more space inside the mold after releasing the walls for cleaning and maintenance. Removing the walls before the shrinkable core could affect the wall and the shrinkable core 100.

As next step, the steel structured is installed inside the one or more mold cavities 200*a*, 200*b*. Additional accessories may be installed on top of the one or more shrinkable cores 100*a*, 100*h* and the molds 200 to direct the concrete mix inside the mold cavities 200. After pouring the concrete mix inside the mold cavity vibratos (e.g. hand held or fixed) may be used to smoothly fill the molds with concrete until it becomes a viscous material. The reason for pouring the concrete vertically is to achieve a unitary wall casted in a single step. After pouring is finished, the concrete is left to set and dry. Steam may be turned on to speed the drying process. It is left for about 3-4 hours to become solid.

When the concrete is dry and solid, the shrinkable core 100 is retracted to its closed position so that the one or more shrinkable cores 100*a*, 100*b* are easily to release from the mold. The attachment elements 630 are un-tightened from the top by using elements 530 and the crane lifts the shrinkable core to its storing location.

The molds doors (i.e. the first outer wall 210, the second outer wall 220, first outer side wall 212, the second outer side wall 222) are opened in order to lift the precast wall without damaging the mold's walls. The precast walls are lifted and are taken to its curing and storing location. Finally, the mold is cleaned and prepared for the next production shift or day.

The embodiments described above and the accompanying drawing merely serve to illustrate the subject matter of the present invention and the beneficial effects associated therewith, and should not be understood to imply any limitation. The features of the invention, which are disclosed in the description, claims and drawings, may be relevant to the realization of the invention, both individually and in any combination.

The invention claimed is:

1. A mold arrangement (300) for precasting load bearing wall panels, the mold arrangement (300) comprising:

I. a shrinkable core (100) for inserting in a mold cavity (200), the shrinkable core (100) having:

A. a first wall (110) and a second wall (120) being spaced from each other by a first distance (d1) to define an internal region (115) in-between;

B. a first side element (112) and a second side element (122) arranged to close opposite edge portions of the spaced first wall (110) and second wall (120) such that fluid concrete cannot pass the opposite edge portions to get into the internal region (115), the first side element (112) and second side element (122) being spaced by a second distance (d2); and C. a spacing element (130) configured to vary at least one of the first distance (d1) and the second distance (d2) such that a circumference along the first and second walls (110, 120) and the first and second side elements (112, 122) shrinks monotonically with lowering said at least one distance;

II. a first outer wall (210) and a second outer wall (220) being arranged oppositely to each other; and III. a first outer side wall (212) and a second outer side wall (222) being arranged opposite to each other and combined with the first and second outer wall (210, 220) to form a mold cavity (200) there-between;

wherein the shrinkable core (100) is arranged in the mold cavity (200) such that the first and second wall (110, 120) are arranged in parallel to the first and second outer wall (210, 220);

wherein at least one of the first and second outer side walls (212, 222) has a protrusion (231) which extends in the mold (200) and is configured to get into contact with at least one of the first and second side elements (112, 122) of the shrinkable core (100) when the shrinkable core (100) is inserted in the mold (200) such that after casting the load bearing wall panel with a cavity formed by the shrinkable core (100), the cavity comprises a further opening perpendicular to two openings along the lateral extending of the shrinkable core (100); and wherein the outer side wall (212) has further projections (250) extending from a bottom part to a top of the first outer side wall (212), and the second outer side wall (222) comprises further grooves (240) extending from a bottom part (610) to a top of the second side wall (222), wherein the further projections (250) and the further grooves (240) are configured to cast grooves and projections at the side parts of the precast load bearing wall panel which are adapted to engage with each other when connecting the precast walls with each other.

* * * * *